US009895617B2

(12) United States Patent
Schwartz

(10) Patent No.: US 9,895,617 B2
(45) Date of Patent: Feb. 20, 2018

(54) SLIDE ENTRY SYSTEM

(71) Applicant: Universal City Studios LLC, Universal City, CA (US)

(72) Inventor: Justin Michael Schwartz, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 15/353,515

(22) Filed: Nov. 16, 2016

(65) Prior Publication Data

US 2017/0056778 A1 Mar. 2, 2017

Related U.S. Application Data

(63) Continuation of application No. 14/680,544, filed on Apr. 7, 2015, now Pat. No. 9,511,297.

(51) Int. Cl.
*A63G 21/18* (2006.01)

(52) U.S. Cl.
CPC ..... *A63G 21/18* (2013.01)

(58) Field of Classification Search
CPC ..... A63G 3/00; A63G 21/00; A63G 21/16; A63G 21/18; A63G 31/00; A63G 31/007; A63G 33/00
USPC ..... 472/13, 116–117, 128, 129; 405/79–80, 405/87, 100, 104; 104/69–70
See application file for complete search history.

(56) References Cited

U.S. PATENT DOCUMENTS 5,183,437 A 2/1993 Millay
5,482,510 A * 1/1996 Ishii ..... A63G 31/16 472/61
5,704,294 A 1/1998 Van Winkle et al.
6,045,449 A 4/2000 Aragona et al.
6,475,095 B1 * 11/2002 Henry ..... A63G 3/00 405/79
6,527,646 B1 3/2003 Briggs
7,967,692 B2 * 6/2011 Werner ..... A63G 21/18 434/44

(Continued)

FOREIGN PATENT DOCUMENTS

CN 202777764 3/2013
DE 20120561 3/2002

(Continued)

OTHER PUBLICATIONS

PCT/US2016/026198 International Search Report and Written Opinion dated Jul. 18, 2016.

*Primary Examiner* — Kien Nguyen
(74) *Attorney, Agent, or Firm* — Fletcher Yoder, P.C.

(57) ABSTRACT

A water slide entry system in accordance with present embodiments may include an entry platform configured to support a rider above a water slide entry and an enclosure defining an enclosed space about the platform configured to at least partially enclose the rider when the rider is positioned on the entry platform. The water slide entry system may also include a fluid delivery system configured to deliver fluid within the enclosure to a predetermined fill level and a control system configured to receive a signal that the rider is positioned on the entry platform; provide instructions to the fluid delivery system to deliver the fluid within the enclosure when the rider is positioned on the entry platform; and trigger the entry platform to release the rider into the water slide entry.

20 Claims, 6 Drawing Sheets

(56) References Cited

U.S. PATENT DOCUMENTS

| | | | |
|---|---|---|---|
| 2012/0028724 | A1 | 2/2012 | Ensing |
| 2014/0329610 | A1 | 11/2014 | Theilgaard |
| 2016/0059138 | A1 | 3/2016 | Braun |

FOREIGN PATENT DOCUMENTS

| | | | |
|---|---|---|---|
| JP | 03139380 | A | 6/1991 |
| WO | 9203201 | | 3/1992 |
| WO | WO9733668 | A1 | 9/1997 |
| WO | WO13066155 | A1 | 5/2013 |
| WO | WO13130072 | A1 | 9/2013 |

* cited by examiner

SLIDE ENTRY SYSTEM

CROSS REFERENCE TO RELATED APPLICATION

This application is a continuation of U.S. patent application Ser. No. 14/680,544, entitled "SLIDE ENTRY SYSTEM", filed Apr. 7, 2015 which is hereby incorporated by reference in its entirety.

BACKGROUND

The present disclosure relates generally to the field of amusement parks. More specifically, embodiments of the present disclosure relate to methods and equipment utilized to provide amusement park experiences.

Water parks seek to provide a variety of ride experiences for park visitors, including bumper or raft rides, water slides, log rides, water coasters, and lazy rivers. A typical water slide begins in a small pool at the top of the slide, where a rider begins their descent by traveling to the edge of the pool. Certain types of water slides may incorporate narrative-driven effects to enhance the ride experience. For example, the ride may incorporate a building or setting not typically associated with a water ride, such as a bomb shelter or alien landscape. A ride on a water slide may be initiated after a gate or other barrier of an entry system is removed from blocking entry to the ride path to allow a rider to enter the actual slide. It is now recognized that certain entry systems may provide additional appeal to riders by adding thrilling aspects to ride entry, which may, for example, coordinate with thematic components or effects of the slide to add elements of surprise and exciting sensations.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a water slide entry system is provided. The entry system includes an entry platform configured to support a rider above a water slide entry; an enclosure defining an enclosed space about the platform configured to at least partially enclose the rider when the rider is positioned on the entry platform; and a fluid delivery system configured to deliver fluid to a predetermined fill level within the enclosure. The water slide entry system also includes a control system configured to: receive a signal that the rider is positioned on the entry platform; provide instructions to the fluid delivery system to deliver the fluid within the enclosure when the rider is positioned on the entry platform; and trigger the entry platform to release the rider into the water slide entry.

In accordance with another embodiment, a method is provided. The method includes the steps of receiving a signal that a rider is positioned on an entry platform, wherein the entry platform is positioned within an enclosure and above a water slide; activating a fluid flow in the enclosure to partially fill the enclosure to a predetermined fluid level; and opening the entry platform to release the rider into the water slide when the fluid reaches the predetermined fluid level.

In accordance with another embodiment, a method is provided. The method includes the steps of receiving a signal that a rider is positioned on an entry platform, wherein the entry platform is positioned within an enclosure and above a water slide; activating a fluid flow in the enclosure for a predetermined time period; and opening the entry platform to release the rider into the water slide after the predetermined time period has expired.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure relates to slide entry systems that may be used in conjunction with amusement park rides. Water slides (e.g., chutes) are typically designed for riders to enter legs first from an entry pool, with the rider entering the entry at his own pace. To enhance the speed and excitement of the rider's entry into the water slide, present embodiments use a trap door entry. For example, a rider may enter an enclosure that is suspended above the slide. Once the rider is properly positioned, a trap door underneath the rider's feet is opened, and the rider falls directly into the slide entry. Because the rider does not control the precise moment that the trap door opens, an element of surprise is introduced that increases the excitement associated with ride. Indeed, a water slide in accordance with present embodiments may initiate when a trap door in the floor of the entry system opens to release a rider from an erect or reclining position down a water slide. The combination of the physical sensation of the floor falling out from beneath the rider in combination with the element of surprise within the narrative of the ride is thrilling.

Provided herein are slide entry systems that incorporate one or more features that may enhance a water slide entry for the rider and, that, in certain embodiments, may be incorporated into water slides that use a trap door or other platform-based entry. In one embodiment, the slide entry system includes an enclosure that surrounds an entry platform. After the rider is positioned within the enclosure, the enclosure starts to fill with water. Although the rider is aware that the enclosure will open and release into the slide before water rises above his head, the experience of watching the water levels rise may increase the excitement associated with the ride. In addition, the enclosure may agitate the water, or the water may include additives (e.g., soap, dye) to create visual effects. Such visual effects may not only enhance the rider's experience, but may also create visual excitement for those waiting in line, making the ride and waiting in the ride queue more appealing to park visitors.

While the disclosed embodiments are generally described in the context of water rides, water slides, or rides that include a water component, it should be understood that the slide entry systems as provided herein may also be used in conjunction with other types of rides, such as platform-based free fall rides. For example, rather than opening the entry platform and releasing a rider into a slide (e.g., water slide), the entry systems as provided herein may be used to release the rider and entry platform together as in a free-fall ride.

Figure 1:
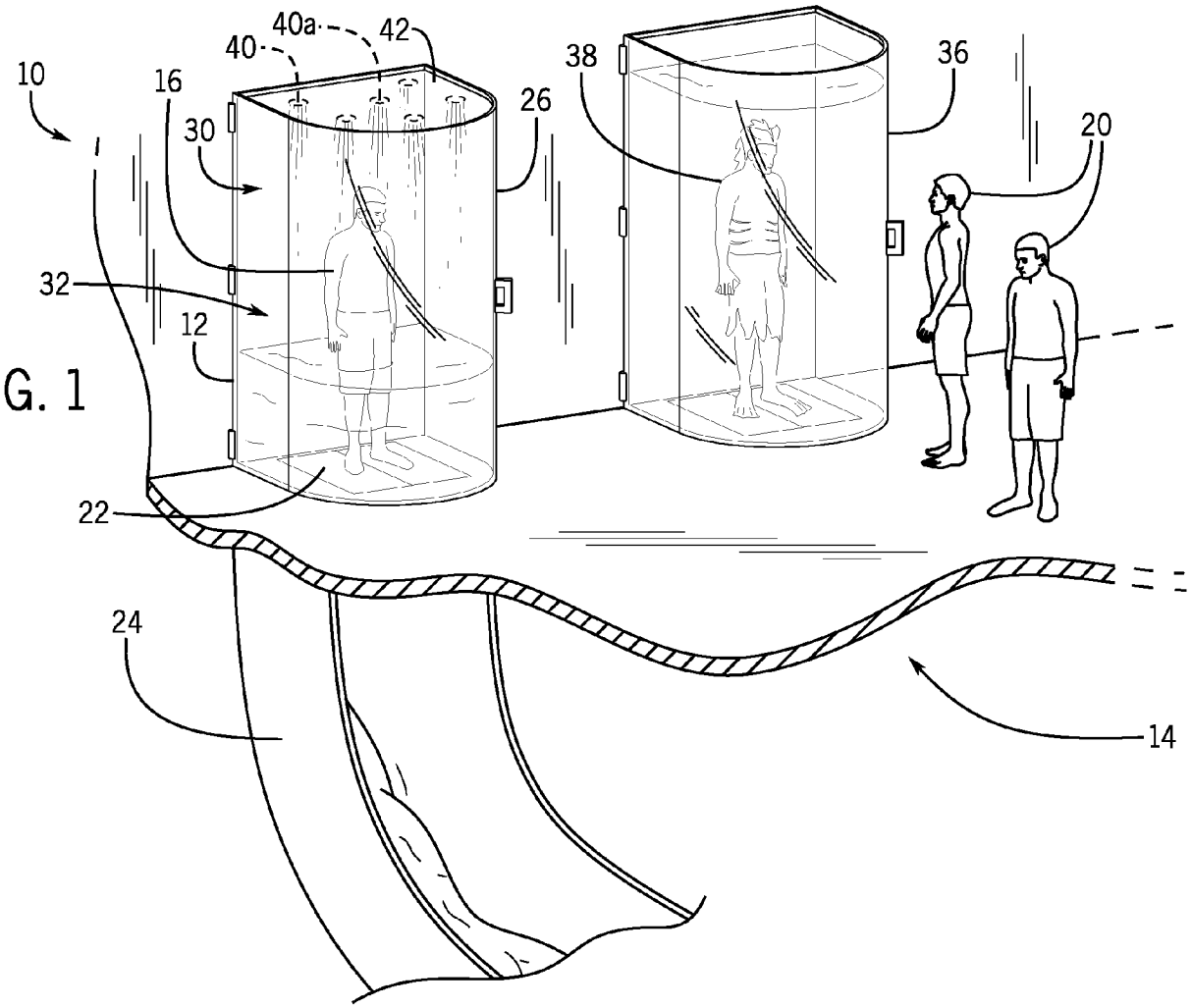
FIG. 1 is a perspective view of a water slide including a slide entry system in accordance with present techniques.

FIG. 1 is a perspective view of a water ride 10 with a slide entry system 12 as provided herein. As shown, the water ride 10 may include a ride environment 14 that, in certain embodiments, may provide narrative features to enhance the ride experience for rider 16 as well as those observers 20 who may be queuing for the water ride 10. In the depicted environment, the rider 16 is positioned within the slide entry system 12 on an entry platform 22 that suspends the rider 16 above an entrance to a water slide 24. The entry platform 22 is within an enclosure 26 such that the rider 16, when in position on the entry platform 22, is generally isolated from the rest of the ride environment 14 in an enclosed space 30 defined by the walls 32 of enclosure 26. Such an arrangement may allow the rider 16 to prepare for the sudden entry into the water slide 24 when the entry platform is triggered without distractions from the observers 20. In addition, the sound and physical isolation within the enclosure 26 may increase the sense of anticipation for the rider 16. In certain embodiments, at least a portion of the walls 32 may be formed from a clear or translucent material that allows both the rider 16 and the observers 20 to view one another.

The slide entry system 12 may also include features that direct fluid flow into and/or within the enclosure 26 to provide the visual image of the enclosed space 30 filling with water or other fluids (e.g., fog, foam, slime effects). Not only is this thrilling for the rider 16, but the image of the rider 16 being enclosed in a fluid-filled space may also provide excitement to the observers 20. For example, the water effect may be part of the water ride narrative. In one example, the ride environment 14 supports a narrative in which a villain captures live specimens for study or dissection. The ride environment 14 may include additional enclosures 36 that are not linked to the water slide 24, but instead are shaped to resemble specimen containers with formaldehyde-preserved monsters (e.g., creature 38). The rider enclosure 26 may also be formed in a similar manner such that it appears that the rider 16 is an additional specimen in the lab when positioned in the enclosure 26. Audio or other effects may be provided to narrate to the rider 16 and/or the observers 20 that the water is a preservative to preserve the rider and that the observers 20 will be preserved next. In another embodiment, the enclosure may form a coffin to support a vampire-based ride narrative. In such an embodiment, the rider 16 may be a newly-converted vampire and the fluid may be dyed to resemble blood.

The water may fill the enclosure from any suitable inlet, which may be positioned to support the narrative or to create additional effects for the rider 16. For example, the fluid inlet port or ports 40 may be positioned on or at the level of the entry platform 22, which may facilitate the visual effect of water filling from the bottom of the enclosure 26. Such an effect may support a narrative that the rider 16 is in a race against time to escape enclosure 26 before the water reaches his head. It should be understood that, as provided herein, the fluid only partially fills the enclosure 26 (e.g., does not fill higher than the rider's knees or waist). In one embodiment, the volume of the enclosed space 30 of the enclosure 26 may be configured to fill to a predetermined level of (e.g. retain the fluid until the rider 16 is released) up to 10%, 25%, 30%, 40%, or 50% fluid by volume. For example, at a 50% predetermined fill level, 50% of a total volume in the enclosed space is taken up with fluid. In one embodiment, as depicted, the fluid inlet ports 40 may be integrated within a ceiling or top 42 of the enclosure 26. Such an arrangement may provide the advantage of creating a rain or deluge visual effect with the fluid. In particular, such an effect may require less fluid by volume to create dramatic visual effects more quickly within the enclosure 26 relative to an embodiment in which the water fills from the bottom of the enclosure 26. Such an embodiment may be advantageous for rides that typically have long queues and high rider-throughput requirements. In addition, by positioning the fluid inlet ports at or near the top 42 of the enclosure 26, the force of the water streaming down within the enclosed space 30 may also serve to agitate additives within the fluid, e.g., detergents or dyes, to create foam and/or color effects. Accordingly, the fluid inlet ports 40, regardless of their position, may release the fluid under suitable pressure, depending on the desired effects (e.g., agitation, rainfall effects). Further, by creating a shower of fluid, the rider 16 may be fully soaked within the enclosure even before entering the slide 24, which may be more thrilling and enjoyable for the rider 16 as well.

In one embodiment, the slide entry system 12 may include a specialized fluid inlet port **40*a* among the fluid inlet ports 40 dedicated to adding a second fluid to the fluid flow and that is supplied from a different fluid source than the main fluid inlet ports 40. For example, in one embodiment, a ride narrative may include a projected or holographic image of a blade entering the enclosure 26 after the fluid flow has been initiated. The specialized fluid inlet port 40*a* may then flow red dyed fluid into the accumulated fluid in the enclosed space 30 to create the visual effect of blood within the enclosure 26. In another embodiment, the specialized fluid inlet port 40*a* may be an air port that, once the fill level of the water or other fluid has reached a desired level, may inject air into the fluid to create whirlpool or turbulence effects. In another embodiment, individual fluid inlet ports 40 may be configured to switch fluid sources via valve controls to provide more flexibility in positioning specialized fluid ports 40*a* at various positions within the enclosure 26**.

Figure 2:
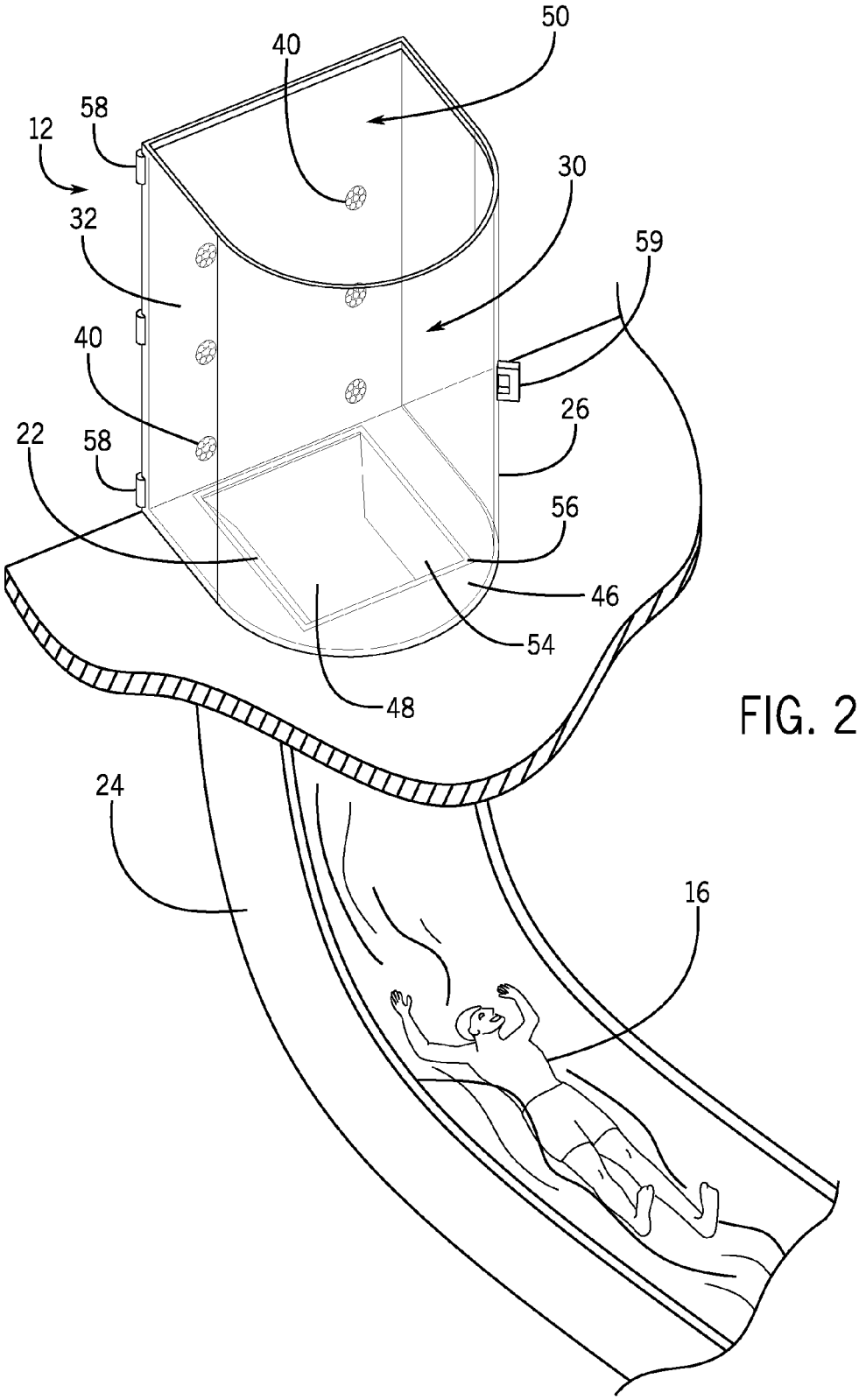
FIG. 2 is a perspective view of a slide entry system with an entry platform in the open configuration after the rider has been released into the water slide in accordance with present techniques.

FIG. 2 illustrates a perspective view of a slide entry system 12 after the entry platform 22 has released the rider 16 into the water slide 24. In the depicted embodiment, the entry platform 22 is positioned within a supporting platform 46. In operation, the rider 16 assumes a position with both feet on the entry platform 22. In other embodiments, the entry platform 22 may form all or most of the bottom surface of the enclosure 26. Once the rider 16 is in place, the entry platform 22 is triggered to open. The entry platform 22 may be implemented in any suitable configuration to facilitate quick release of the rider 16 through an opening 48 formed in the open configuration. In one embodiment, the entry platform 22 and other components of the enclosure 26 (e.g. the walls, door, etc.) may be configured to be sealed against water egress to facilitate fluid filling and/or retention until being triggered. Accordingly, the entry platform mechanics and other components may also be configured to seal the enclosure 26 and the weight of the fluid volume in the enclosure 26 is complete as well as the weight of the rider 16. That is, during operation when the rider 16 is present, the enclosure 26 may be designed to seal the fluid at various fill levels, including at a desired fill level.

The opening 48 is open to the water slide 24 and is suitably sized and shaped to permit the rider 16 to fall into the water slide 24. Although the depicted embodiment is shown with the enclosure 26 generally upright, it should be understood that the enclosure 26 may be angled or positioned to place the rider 16 at an angle when positioned for release into the water slide 24. For example, a back surface 50 of the enclosure 26 may be inclined to match an angle of the water slide 24 such that the rider 16 is released into the water slide at an angle generally matched to the angle of the water slide 24. Such an embodiment may allow the rider 16 to reach higher speeds more quickly within the water slide 24. It should also be noted that at least some of the accumulated water within the enclosure will enter the slide with the rider.

The entry platform 22 may include a trap door or doors 54 coupled to a frame 56. In the depicted embodiment, the trap door 54 includes two separable doors that are simultaneously triggered to drop within the opening 48 to release the rider 16. Other embodiments may be implemented with a single door. Further, while the trap door 54 may open downward towards the water slide 24, in other embodiments, the entry platform 22 may slide horizontally relative to the enclosure 26 to create the opening 48 and release the rider 16. The mechanical components of the entry platform 22 may be configured such that any hinges or other features that facilitate opening of the trap door 54 are located outside of the enclosed space 30 to avoid interference with slide entry or contact with the rider 16. The enclosure 26 may include certain features to permit a ride technician to position the rider 16 at the entry. For example, the side or front walls 32 of the enclosure 26 may be coupled to the back surface 50 by hinges 58 to swing open (e.g., using a handle 59) and allow entry to the enclosed space 30. In the depicted embodiment, the side or front walls include fluid inlet ports 40 positioned about the circumference of the enclosure 26 and at different heights relative to the entry platform. Alternatively or additionally, the back surface 50 may include one or more fluid inlet port 40. The fluid may be directed to flow from the fluid inlet ports 40 around the rider 16 from several directions, which may provide an enjoyable or thrilling experience. In addition, the fluid flow from various fluid inlet ports 40 may be activated at different times to provide different effects.

Figure 3:
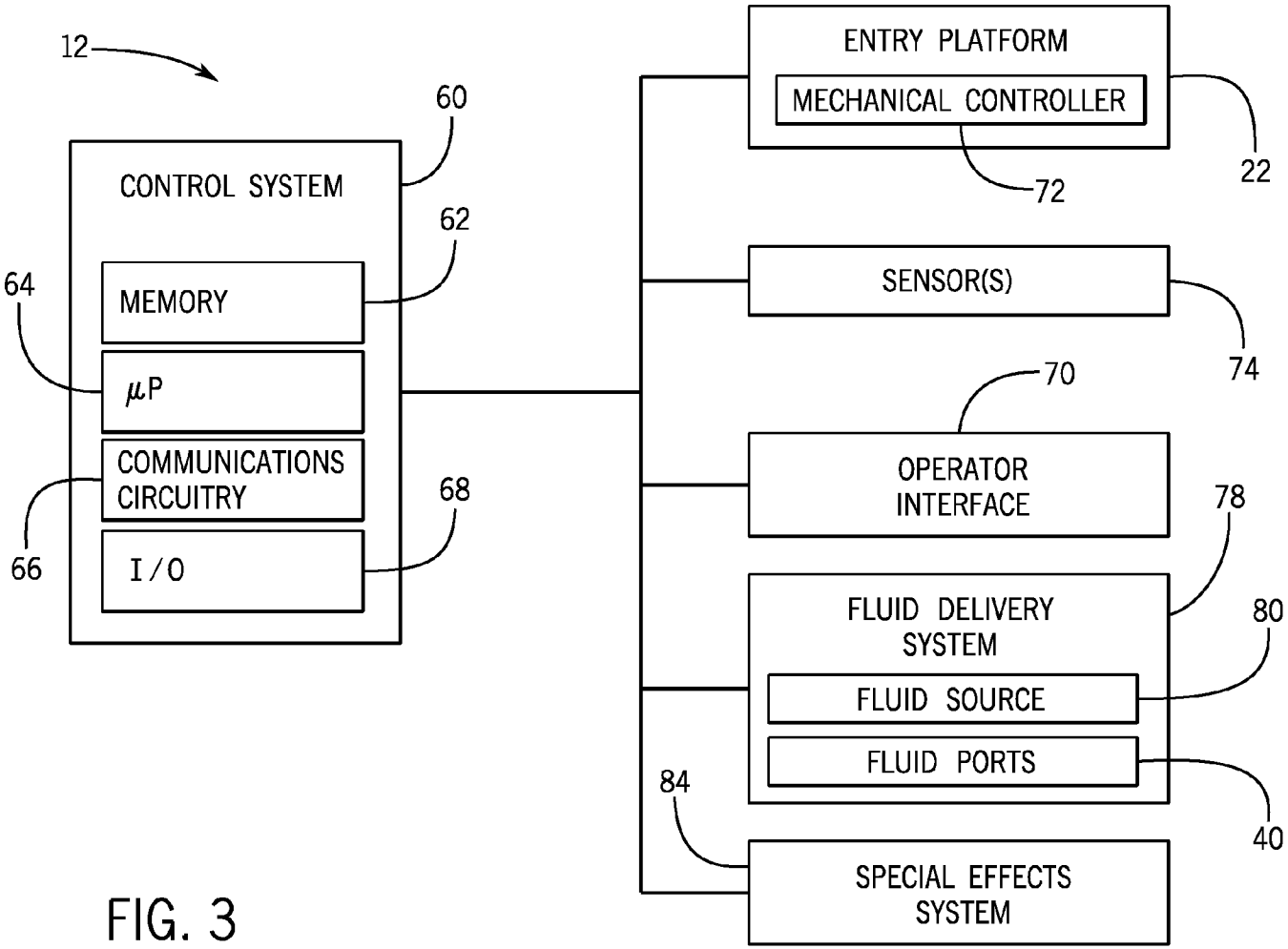
FIG. 3 is a block diagram of a system for implementing a slide entry system in accordance with present techniques.

Once the rider 16 is in place, the ride technician may then provide the appropriate input to trigger the entry platform 22. In another embodiment, the entry platform 22 may be triggered based on signals from one or more sensors that assess rider position or presence. Accordingly, the slide entry system 12 may operate under a control system 60, as shown in the block diagram of FIG. 3. The control system 60 may include a processor 62, which may include one or more processing devices, and a memory 64 storing instructions executable by the processor 62. The memory 64 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 62 or by any general purpose or special purpose computer or other machine with a processor. The control system 60 may also include communications circuitry 66 and/or input and output circuitry 68 to facilitate communication with other components of the slide entry system 12. In addition, the control system 60 may be coupled, either directly or wirelessly, to an operator input device or operator interface 70 that, in operation, may be used by a ride technician to provide input used to control one or more ride features. As noted, the operator interface 70, or other components of the system 12, may be located remotely from the control system 60 in certain embodiments and may be, for example, implemented on a mobile device.

The control system 60 may control the opening and closing of the entry platform 22. For example, the entry platform 22 may include a mechanical controller 72 that allows the door (e.g., trap door 54 of FIG. 2) to open. In one embodiment, the mechanical controller may control a latch. Upon receiving a signal from the control system 60, the mechanical controller 72 opens the latch, for example by retracting a pin or controlling an electromagnet, to allow the door to fall open. The mechanical controller 72 may also control a motor that brings the door back to the entry platform 22 to prepare for the next rider 16.

The signal to trigger the entry platform 22 may be based at least in part on a signal from a ride technician that the rider 16 is correctly positioned on the entry platform 22. Alternatively or additionally, the slide entry system 12 may include one or more sensors 74 that provide input to the entry platform triggering. For example, the entry platform may include a pressure sensor that provides feedback that a rider 16 within an allowed or expected weight range is on the entry platform 22. Other sensors 74 that may provide feedback that the rider is in place include optical sensors, camera or facial recognition sensors, etc. In one embodiment, the ride technician may provide a trigger signal (e.g., by pressing a button or providing feedback via the operator interface 70), and the control system 60 may be configured to only trigger the entry platform 22 when the sensor or sensors 74 provide signals that confirm that the rider is in place. If the sensor or sensors 74 do not indicate that the rider 16 is in place, the entry platform 22 will override the ride technician signal and not trigger. In addition, the sensor or sensors 74 may include other types of sensors that assess fluid fill levels, fluid pressure, etc.

The control system 60 may also control a fluid delivery system 78 that activates and/or stops delivery of fluid to the enclosure 26. The fluid delivery system 78 includes one or more fluid sources 80 in fluid communication with one or more fluid inlet ports 40. Upon receiving a signal from the control system 60, the fluid delivery system 78 may open the flow of fluid to the enclosure 26, e.g., by opening a valve to release the fluid. Accordingly, the fluid delivery system 78 may include suitable flow control elements, such as valves configured to be operated under control of the control system 60. In one embodiment, the fluid delivery system 78 may be configured to release a second fluid type at a particular time point under the control of the control system 60. In addition, the control system 60 may also control deactivation of fluid flow and/or fluid draining. In one embodiment, the fluid flow is automatically shut down and/or drained if the fill level rises above a predetermined level, which may be determined by one or more of an operator input or a sensor feedback.

In certain embodiments, the slide entry system 12 may also include one or more special effects systems 84 under control of the control system 60. Such special effects may include light effects, motion effects, sound effects, image effects etc. A special effects system 84 may be configured to coordinate with the fluid effects as provided herein. For example, sound effects of rushing water may be triggered concurrently with the fluid flow to create the overall impression of a deluge of water rushing into the enclosure 26. In other embodiments, the special effects system 84 may be configured to agitate the fluid within the enclosure to create waves.

Figure 4:
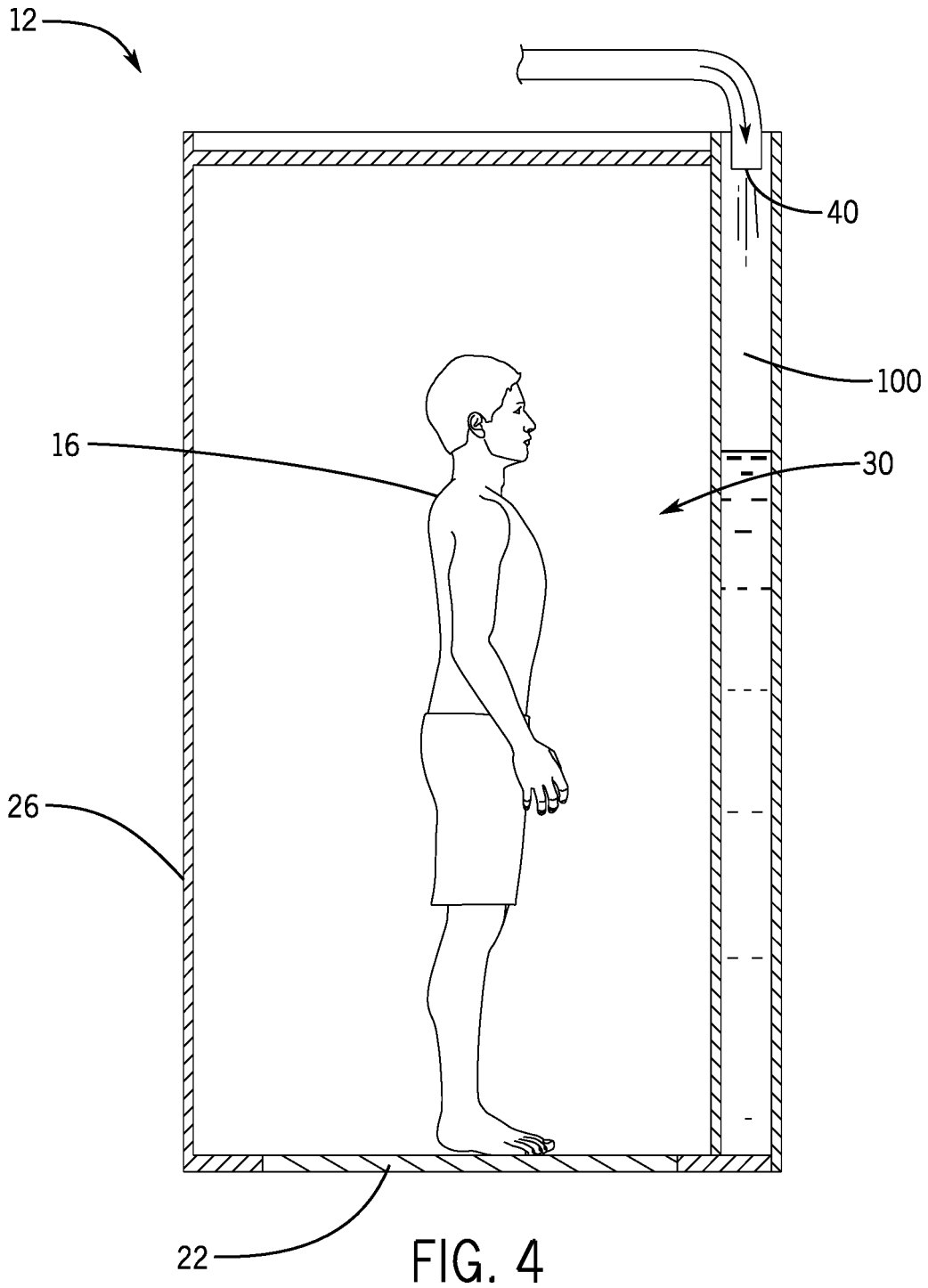
FIG. 4 is a cross-sectional view of a slide entry system in which the fluid fills a cavity in the enclosure wall in accordance with present techniques.

While certain embodiments of the disclosure have provided slide entry systems 12 that facilitate fluid flow within the enclosed space 30 formed by the enclosure 26, the fluid flow may also be directed into a cavity 100 in the walls 32 of the enclosure 26, as shown in the cross-sectional view of FIG. 4. In one embodiment, the fluid flows into the cavity 100 and does not enter the enclosed space 30. Such an embodiment allows the rider 16 to remain dry and may also require less fluid volume to achieve. In addition, because the rider 16 and the fluid do not come into direct contact, the cavity 100 may fill to levels above the rider's head to create an illusion that the rider 16 is submerged in fluid within the enclosure 26. In other embodiments, the fluid flow into the cavity 100 may be combined with fluid flow within the enclosed space 30 to create layered effects. For example, the fluid in the cavity 100 may have different refractive properties than the fluid in the enclosed space 30. Further, filling the cavity 100 in conjunction with filling the enclosed space 30 provides a combined impact on riders' senses. In one embodiment, the cavity 100 fills and also drains directly into the enclosed space 30 at a slower rate, allowing the cavity 100 to fill but also allowing the rider 16 to experience fluid flowing from the translucent walls 32 of the enclosure 26.

Figure 5:
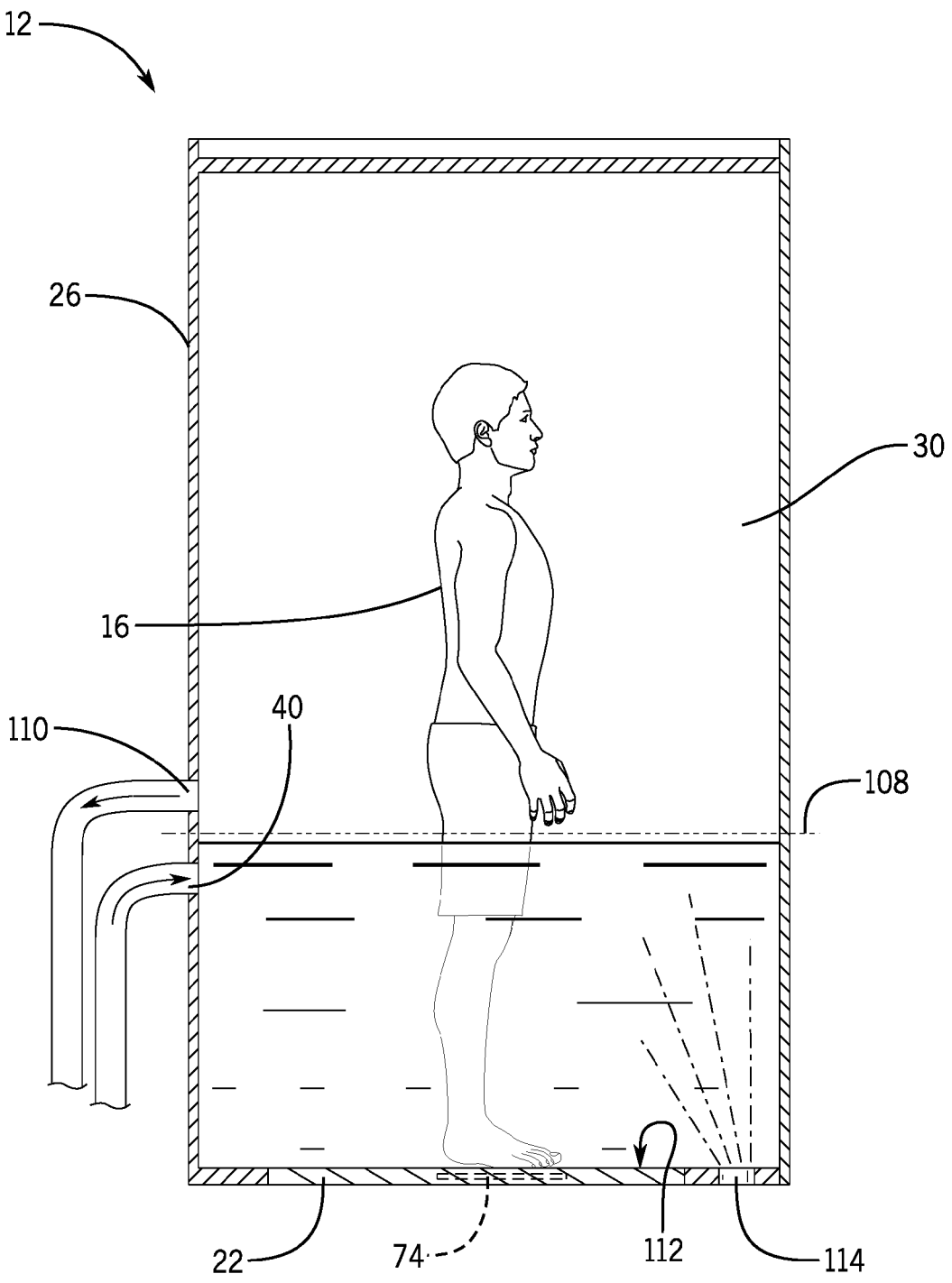
FIG. 5 is a cross-sectional view of a slide entry system in which the fluid fills the enclosed space in accordance with present techniques.

As provided herein, the enclosure 26 of the slide entry system 12 may partially fill with fluid. The fluid may be released with the rider 16 into the water slide 24 or, in certain embodiments, may be separately drained to avoid adding any dyes or foams to the general pool of water. In addition, the enclosure may include one or more drainage systems that maintain fluid at desired fill levels. FIG. 5 is a cross-sectional view of a slide entry system 12 that includes integral fluid drainage. In the depicted embodiment, the fluid inlet port 40 facilitates fluid inflow into the enclosed space 30, for example upon receiving a signal from a weight or impedance sensor 74 that confirm the presence of the rider 16 in the enclosure 26. An outlet port 110, positioned above a desired fill level 108, drains any fluid above the desired fill level 108. In one embodiment, the outlet port 110 is an overflow drain or a valve configured to open when a fluid pressure is above a certain level. In other embodiments, the outlet port or ports 110 may be under processor control (e.g., by the control system 60) to open based on feedback from one or more fluid level sensors 74. The outlet port 110 may also be configured to drain directly into the water slide 24. In one embodiment, the outlet port 110 may be positioned in a bottom surface 112 of the enclosure 26 and configured to drain based on a signal that the fluid level is above the desired fill level 108.

The drainage may also be configured based on the presence and type of fluid or fluid additives. For example, fluid that is dyed or that is not water may be separately drained to keep such fluid isolated from the general pool of water. In configurations in which the fluid is drained directly into the water slide, color effects may be created or enhanced by using colored lights. The depicted embodiment also shows a light source 114 positioned proximate to the entry platform 22 on the bottom surface 112 and configured to emit light into the fluid. In this manner, the fluid may be lit to take on certain colors without the use of dye, which may dye the riders' own clothes and may dye the general pool of water for the ride. In addition, the light may be a black light that facilitates fluorescent effects within the enclosure 26. The light source 114 may also be employed within the cavity 100 to achieve similar results.

Figure 6:
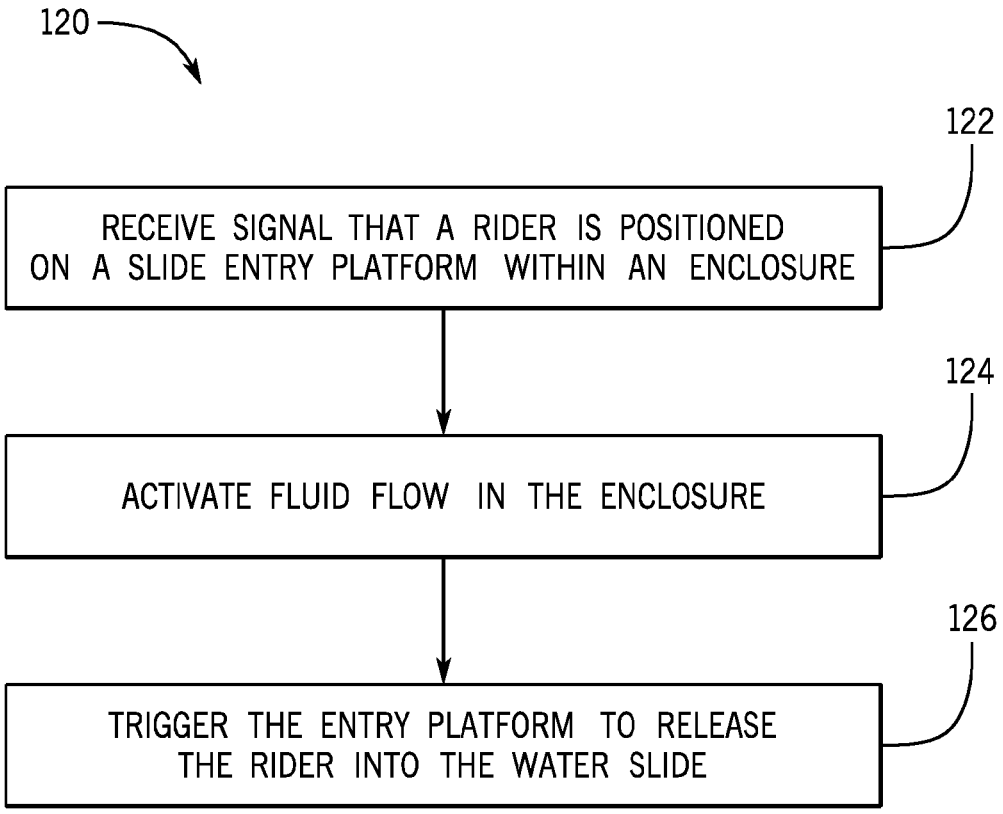
FIG. 6 is a flow diagram of a method of activating fluid flow features of the slide entry system in accordance with present techniques.

FIG. 6 is a flow diagram of a method 120 of operating the slide entry system 12. As noted, the system 12 may receive a signal that the rider is positioned within the enclosure 26 (block 122). The signal may be one or both of an operator input or a sensor feedback. Upon receipt of the signal, fluid flow within the enclosure is activated (block 124). As noted, the fluid flow 124 may be under processor-based control of the control system 60. In addition, any accompanying special effects may also be activated concurrently with the fluid flow. The fluid flow may be under volume or time control. That is, in one embodiment, the fluid flow is maintained until a desired fill level is reached, which may be determined based on operator input and/or sensor feedback. In another embodiment, the fluid flow may continue until expiration of a timer. For example, the timer may be set based on a predetermined volume of the enclosed space 30, an average displacement of the rider 16, the flow rate of the fluid inlet ports 40, and a desired fill level (e.g., a fill level that fills to no higher than waist height for the shortest possible rider). In a specific embodiment, the fill level may be dynamically adjusted based on the anatomy of an individual rider 16. Once the desired fill level is achieved, the entry platform 22 is triggered to release the water into the water slide (block 126). The trigger may be automatic, e.g., based on a feedback signal that the fill level has been reached or that the timer has expired. In one embodiment, the trigger may be based on an operator input. For example, a ride technician may make a visual assessment of the fill level and trigger the entry platform 22 accordingly.

While only certain features of the present disclosure have been illustrated and described herein, many modifications and changes will occur to those skilled in the art. Further, it should be understood that components of various embodiments disclosed herein may be combined or exchanged with one another. It is, therefore, to be understood that the appended claims are intended to cover all such modifications and changes as fall within the true spirit of the disclosure.

The invention claimed is:

1. An entry system for a water slide, comprising:

an entry platform configured to support a rider above a water slide entry;

an enclosure defining an enclosed space about the entry platform configured to at least partially enclose the rider when the rider is positioned on the entry platform;

a fluid delivery system configured to deliver fluid within the enclosure; and a control system configured to:

receive a signal that the rider is positioned on the entry platform;

provide instructions to the fluid delivery system to deliver the fluid within the enclosure to a predetermined fill level when the rider is positioned on the entry platform;

provide instructions to activate a special effect while the fluid delivery system is delivering the fluid; and trigger the entry platform to release the rider into the water slide entry.

2. The entry system of claim 1, wherein the instructions to active the special effect cause a light source to turn on.

3. The entry system of claim 2, wherein the light source is a colored light source.

4. The entry system of claim 2, wherein the light source is a fluorescent light source.

5. The entry system of claim 1, wherein the special effect is a sound effect.

6. The entry system of claim 1, wherein the instructions to active the special effect cause the fluid to be agitated within the enclosure.

7. The entry system of claim 1, wherein the enclosure comprises a wall having a cavity, and wherein the fluid is delivered into the cavity.

8. The entry system of claim 7, wherein the cavity is isolated from the entry platform such that the fluid does not contact the rider when the rider is positioned on the entry platform.

9. The entry system of claim 8, wherein the instructions to active the special effect cause a light source to turn on and illuminate the fluid.

10. A method, comprising:

receiving a signal that a rider is positioned on an entry platform, wherein the entry platform is positioned within an enclosure and above a water slide;

activating a fluid flow in the enclosure to partially fill the enclosure to a predetermined fluid level;

activating one or more special effects to operate during the fluid flow; and opening the entry platform to release the rider into the water slide when fluid of the fluid flow reaches the predetermined fluid level.

11. The method of claim 10, wherein activating the one or more special effects to operate during the fluid flow comprises causing a light source to turn on.

12. The method of claim 10, wherein a special effect of the one or more special effects is a sound effect.

13. The method of claim 10, wherein activating the one or more special effects to operate during the fluid flow comprises causing the fluid to be agitated within the enclosure.

14. The method of claim 10, comprising stopping the fluid flow when the fluid has reached a predetermined volume.

15. The method of claim 10, comprising stopping the fluid flow when a predetermined amount of time has passed.

16. An entry system for a water slide, comprising:

an entry platform configured to support a rider above a water slide entry;

an enclosure defining an enclosed space about the entry platform configured to at least partially enclose the rider when the rider is positioned on the entry platform;

a fluid delivery system configured to deliver fluid within the enclosure comprising a first fluid inlet port and a second fluid inlet port; and a control system configured to:

receive a signal that the rider is positioned on the entry platform; and provide instructions to the fluid delivery system to deliver the fluid within the enclosure via the first fluid inlet port and the second fluid inlet port and to a predetermined fill level when the rider is positioned on the entry platform.

17. The system of claim 16, wherein the control system is configured to control the first fluid inlet port separately from the second fluid inlet port to deliver the fluid at different times via the first fluid inlet port relative to the second fluid inlet port.

18. The system of claim 16, wherein the first fluid inlet port is coupled to a first fluid source and the second fluid inlet port is coupled to a second fluid source.

19. The system of claim 16, wherein the first fluid inlet port is positioned at or near a top of the enclosure.

20. The system of claim 19, wherein the second fluid inlet port is positioned at or near the entry platform.

* * * * *